US010463567B2

(12) United States Patent
Shrak

(10) Patent No.: US 10,463,567 B2
(45) Date of Patent: Nov. 5, 2019

(54) SOAP SPINNER

(71) Applicant: Baby Patent Ltd., Ramat Gan (IL)

(72) Inventor: Oren Shrak, Tel Aviv (IL)

(73) Assignee: Baby Patent Ltd., Ramat Gan (IL)

( * ) Notice: Subject to any disclaimer, the term of this patent is extended or adjusted under 35 U.S.C. 154(b) by 103 days.

(21) Appl. No.: 15/669,932

(22) Filed: Aug. 6, 2017

(65) Prior Publication Data

US 2019/0038504 A1 Feb. 7, 2019

(51) Int. Cl.

| | |
|---|---|
| ***A61H 33/00*** | (2006.01) |
| ***B01F 3/04*** | (2006.01) |
| ***B01F 7/00*** | (2006.01) |
| ***B01F 7/04*** | (2006.01) |
| ***B01F 15/00*** | (2006.01) |
| ***F04D 29/18*** | (2006.01) |
| ***F04D 13/06*** | (2006.01) |
| ***F04D 3/00*** | (2006.01) |
| ***F04D 13/08*** | (2006.01) |

(52) U.S. Cl.

CPC ..... *A61H 33/0091* (2013.01); *B01F 3/04453* (2013.01); *B01F 3/04765* (2013.01); *B01F 7/003* (2013.01); *B01F 7/00308* (2013.01); *B01F 7/00733* (2013.01); *B01F 7/04* (2013.01); *B01F 15/00538* (2013.01); *F04D 3/00* (2013.01); *F04D 13/06* (2013.01); *F04D 13/068* (2013.01); *F04D 13/08* (2013.01); *F04D 29/181* (2013.01); *A61H 2201/0173* (2013.01); *A61H 2201/105* (2013.01); *A61H 2201/1215* (2013.01); *A61H 2201/5058* (2013.01); *B01F 2003/04872* (2013.01)

(58) Field of Classification Search

CPC ..... A61H 33/00
USPC ..... 4/541.1; 137/341; 134/186, 56 R
See application file for complete search history.

(56) References Cited

U.S. PATENT DOCUMENTS

| | | | | |
|---|---|---|---|---|
| 1,943,636 | A * | 1/1934 | Stoddard | A47L 15/06 134/186 |
| 2,002,300 | A * | 5/1935 | Stoddard | A47L 15/06 134/182 |
| 2,819,927 | A * | 1/1958 | Svendsen | A45D 27/10 137/341 |
| 3,955,715 | A | 5/1976 | Topor et al. | |
| 4,019,658 | A | 4/1977 | Consaul | |
| 4,625,896 | A | 12/1986 | Rocchelli | |
| 5,348,507 | A | 9/1994 | McGhie et al. | |
| 5,377,366 | A * | 1/1995 | Boyd | A47K 3/122 4/541.1 |
| 5,439,140 | A | 8/1995 | Meyer et al. | |

(Continued)

OTHER PUBLICATIONS

Homemade Bubble Machine—YouTube, 1 page, Nov. 21, 2009 https://www.youtube.com/watch?v=F32PctkY2T8.

(Continued)

*Primary Examiner* — Lori L Baker
(74) *Attorney, Agent, or Firm* — Kligler & Associates

(57) ABSTRACT

An apparatus for use in a bathtub containing water includes an outer shell, a soap holder, configured to hold a liquid soap, at least one set of blades, and a motor disposed within the outer shell and coupled to the set of blades. The motor is configured to form soap bubbles by spinning the set of blades such that the blades lift the water from the bathtub, and pass the lifted water, together with liquid soap from the soap holder, through air.

33 Claims, 6 Drawing Sheets

(56) References Cited

U.S. PATENT DOCUMENTS

| | | | | |
|---|---|---|---|---|
| 5,860,173 | A | 1/1999 | Herring | |
| 5,966,753 | A | 10/1999 | Gauthier et al. | |
| 6,463,600 | B1 | 10/2002 | Conway et al. | |
| 8,240,508 | B2 | 8/2012 | Wegelin et al. | |
| 8,251,110 | B2 | 8/2012 | Bassett et al. | |
| 8,371,514 | B2 | 2/2013 | Finell | |
| 9,172,266 | B2 | 10/2015 | Curtis | |
| 9,301,653 | B2 | 4/2016 | Ciavarella et al. | |
| 9,303,392 | B2 | 4/2016 | Strauli | |
| 9,521,898 | B2 | 12/2016 | Knight | |
| 9,554,675 | B2 | 1/2017 | Babikian et al. | |
| 2008/0272206 | A1 | 11/2008 | Barrett | |
| 2009/0126100 | A1* | 5/2009 | Kenoyer | F24H 1/0081 4/559 |
| 2011/0306265 | A1* | 12/2011 | Mor | A63H 23/12 446/15 |
| 2015/0313421 | A1 | 11/2015 | Wang et al. | |

OTHER PUBLICATIONS

"Fish pond aerator, paddle wheel aerator, aquaculture equipment with high quality competitive price in India", product description, 9 pages, Jun. 1, 2017 https://www.alibaba.com/productdetail/fishpondaeratorpaddlewheelaerator_60251912530.html.

Summer Infant—Summer Infant Tub Time Bubble Maker—product description, 2 pages, Jul. 20, 2017 https://www.summerinfant.com/bath-accessories/tub-time-bubble-maker.

DC Water Pump Motor Brush 6.35mm Shaft with Propeller! AS2601400, 1 page, Nov. 6, 2017 https://www.ebay.com/itm/DC-Water-Pump-Motor-Brush-6-35mm-Shaft-with-Propeller-AS2601400-/140762735090?autorefresh=true.

NQD-757 757-6024 spare propeller for RC 6024 Turbo JET boat replacement x 2 pcs, 2 pages, Nov. 6, 2017 https://www.ebay.com/itm/NQD-757-757-6024-spare-propeller-for-RC-6024-Turbo-JET-boat-replacement-x-2-pcs/122329814952?epid=840658664&hash=item1c7b6cd7a8:g:bbYAAOxyrUZRzEmF.

* cited by examiner

SOAP SPINNER

FIELD OF THE INVENTION

The present invention relates to the field of personal care products.

BACKGROUND

For many people, adults and children alike, taking a bubble bath is an enjoyable and/or therapeutic experience.

A soap bubble is a thin film of soapy water that encloses air.

SUMMARY OF THE INVENTION

There is provided, in accordance with some embodiments of the present invention, apparatus for use in a bathtub containing water. The apparatus includes an outer shell, a soap holder, configured to hold a liquid soap, at least one set of blades, and a motor disposed within the outer shell and coupled to the set of blades. The motor is configured to form soap bubbles by spinning the set of blades such that the blades lift the water from the bathtub, and pass the lifted water, together with liquid soap from the soap holder, through air.

In some embodiments, the apparatus further includes a suction holder coupled to the outer shell, the suction holder being configured to couple the outer shell to a wall of the bathtub.

In some embodiments, the apparatus further includes a mesh configured to couple to the outer shell over the set of blades.

In some embodiments, each of the blades is shaped to define one or more apertures passing from one face of the blade to an opposite face of the blade.

In some embodiments, when the outer shell is partly submerged in the water with a longitudinal axis of the outer shell being parallel to a surface of the water, the set of blades is partly submerged in the water.

In some embodiments, an axis of rotation of the set of blades is parallel to the longitudinal axis of the outer shell.

In some embodiments, the soap holder includes a receptacle shaped to define one or more apertures and configured to couple to the outer shell such that, as the motor spins the set of blades, the soap drips from the receptacle via the apertures.

In some embodiments, the soap holder is configured to couple to outer shell such that the soap drips, via the apertures, onto the blades.

In some embodiments, the soap holder is configured to couple to outer shell such that the soap drips, via the apertures, into the bathtub.

In some embodiments, the apparatus further includes a buoyant cover configured to cover the set of blades.

In some embodiments, the buoyant cover is shaped to define the soap holder.

In some embodiments, the buoyant cover includes a sponge.

In some embodiments, the buoyant cover is shaped to define a plurality of cover-apertures configured to facilitate passage of the water through the buoyant cover.

In some embodiments, the outer shell is buoyant.

In some embodiments, the outer shell is shaped to define an aperture positioned behind the set of blades and in fluid communication with the soap holder, such that, as the motor spins the set of blades, the soap drips, via the aperture, onto the set of blades.

In some embodiments, the soap holder is at least partly contained within the outer shell.

There is further provided, in accordance with some embodiments of the present invention, apparatus for use in a bathtub containing water. The apparatus includes an outer shell, shaped to define one or more apertures, an impeller disposed within the outer shell, a soap holder, contained within the outer shell and configured to hold a liquid soap, at least one set of blades, and at least one motor disposed within the outer shell and coupled to the set of blades and to the impeller. The motor is configured to form soap bubbles while the apertures are submerged in the water, by turning the impeller such that the impeller draws the water, via the apertures, into the soap holder, thus forming a mixture of the water and the liquid soap, and spinning the set of blades such that the blades lift the mixture from the soap holder, and pass the mixture through air.

In some embodiments, the set of blades is at least partly contained within the soap holder.

In some embodiments, an axis of rotation of the set of blades is perpendicular to a longitudinal axis of the outer shell.

There is further provided, in accordance with some embodiments of the present invention, an apparatus including a bathtub, which includes a plurality of walls surrounding a bathing chamber. At least one of the walls is shaped to define a side chamber in fluid communication with the bathing chamber. The apparatus further comprises one or more sets of blades disposed within the side chamber, a soap holder, configured to hold a liquid soap, and at least one motor coupled to the sets of blades. The motor is configured to form soap bubbles by spinning at least one of the sets of blades such that the blades of the at least one of the sets lift water from the side chamber, and pass the lifted water, together with liquid soap from the soap holder, through air.

In some embodiments, the apparatus further includes a mesh that divides between the side chamber and the bathing chamber.

In some embodiments, the one or more sets of blades include a vertically-arranged plurality of sets of blades.

In some embodiments, the soap holder includes a receptacle shaped to define one or more apertures and configured to couple to the bathtub such that, as the motor spins the at least one of the sets of blades, the soap drips from the receptacle, via the apertures, into the side chamber.

In some embodiments, the one of the walls is further shaped to define the soap holder and a passage passing from the soap holder to the side chamber, such that, as the motor spins the at least one of the sets of blades, the soap drips from the soap holder, via the passage, into the side chamber.

There is further provided, in accordance with some embodiments of the present invention, a method that includes, using a motorized set of blades, lifting water from a bathtub, and, using the set of blades, forming soap bubbles by passing the lifted water, together with liquid soap from a soap holder, through air.

In some embodiments, forming the soap bubbles includes forming the soap bubbles by passing the lifted water though the air while receiving the liquid soap from the soap holder.

In some embodiments, the liquid soap drips into the bathtub, thus forming a mixture with the water, lifting the water includes lifting the water by lifting the mixture from the bathtub, and forming the soap bubbles includes forming the soap bubbles by passing the mixture though the air.

In some embodiments, the set of blades is covered by a mesh, and forming the soap bubbles includes forming some of the soap bubbles in a space between the set of blades and the mesh.

In some embodiments, the liquid soap, when contained in the soap holder, is not mixed with water.

There is further provided, in accordance with some embodiments of the present invention, a method that includes drawing water from a bathtub into a soap holder that holds a liquid soap, thus forming a mixture of the water and the liquid soap, and forming soap bubbles by spinning a set of blades such that the blades lift the mixture from the soap holder and pass the mixture though air.

The present invention will be more fully understood from the following detailed description of embodiments thereof, taken together with the drawings, in which:

DETAILED DESCRIPTION OF EMBODIMENTS

Overview

Embodiments of the present invention facilitate the quick and inexpensive generation of bubble baths, using any suitable liquid soap of the user's choosing.

Embodiments described herein include a soap spinner, configured to generate soap bubbles in a bathtub. In some embodiments, the soap spinner comprises at least one set of rotary blades, and a motor configured to spin (or "rotate") the set of blades around a common central axis. The spinner is coupled to the side wall of the bathtub, or is allowed to freely float within the bathtub, such that the set of blades is partly submerged within the water in the bathtub, and is partly exposed to the air above the water. As the blades spin, a liquid soap is fed to the blades (and/or to the bathwater in the vicinity of the blades), such that the blades become covered with soapy water. For example, the soap spinner may comprise a soap dripper, positioned above the set of blades, which drips soap onto the blades (and/or into the bathwater) as the blades spin. As the blades pass through the air, soap bubbles are formed from the soapy water on the blades.

In other embodiments, the spinner comprises an internal soap chamber, which is prefilled with liquid soap, and an impeller. The spinner is coupled to the side of the bathtub, or is allowed to freely float within the bathtub, such that the impeller continuously draws water from the bathtub into the soap chamber, thus forming soapy water. The set of rotary blades is partly submerged within the soap chamber and partly exposed to air, such that, as the blades spin, the blades lift soapy water from the soap chamber into the air, thus forming bubbles from the soapy water.

In yet other embodiments, the bathtub comprises an integrated soap-spinning system. The system comprises one or more sets of motorized rotary blades contained within an open recess in the wall of the bathtub, along with a soap dripper configured to drip liquid soap onto the blades, and/or into the bathwater in the vicinity of the blades.

Typically, each of the blades is shaped to define a plurality of apertures passing from one face of the blade to the opposite face of the blade. Such embodiments have at least two advantages. First, the apertures facilitate greater access to air, such that more bubbles may be formed from a given quantity of soapy water. Second, the apertures reduce resistance to the spinning of the blades, such that a greater rotation speed of the blades—and hence, greater and/or faster bubble formation—may be achieved.

In summary, using embodiments described herein, a large number of bubbles may be quickly generated, using a relatively small amount of any type of liquid soap.

Apparatus Description

Figure 1:
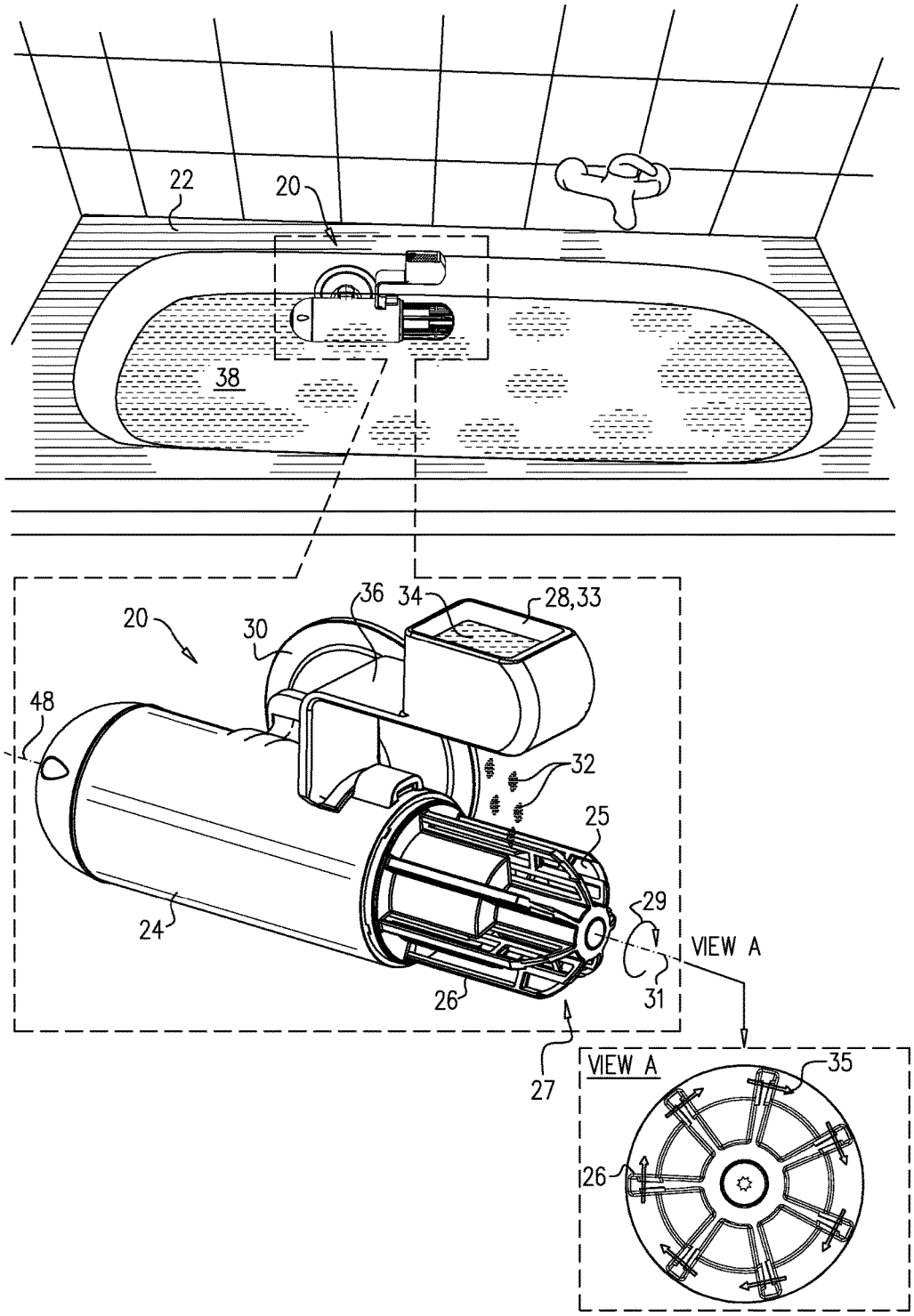
FIGS. 1-3 are schematic illustrations of an apparatus for forming soap bubbles, in accordance with some embodiments of the present invention.
Figure 2:
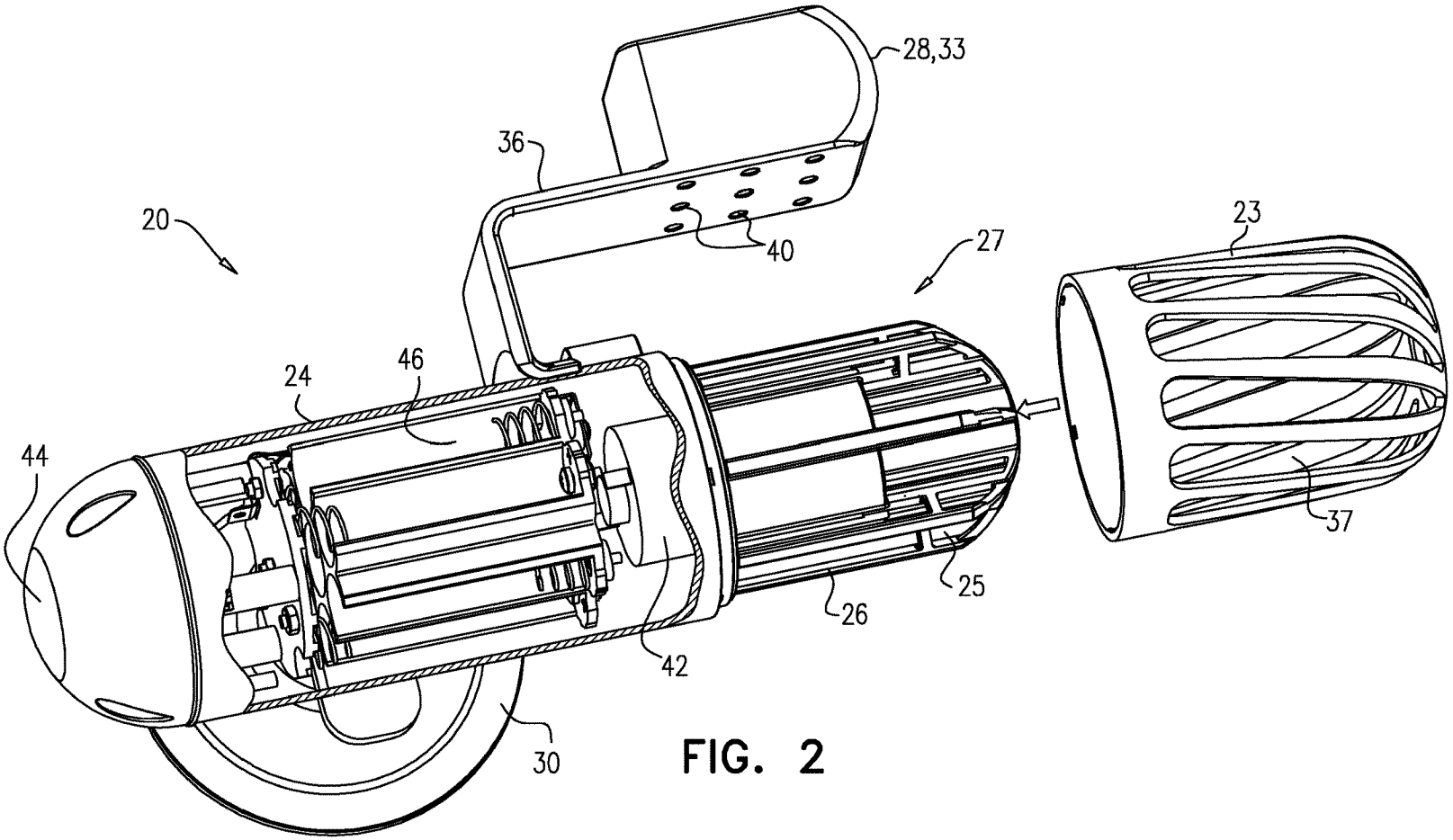

Reference is initially made to FIGS. 1-2, which are schematic illustrations of apparatus 20 for forming soap bubbles, in accordance with some embodiments of the present invention. Apparatus 20 comprises an outer shell 24, which may, for example, be cylindrically shaped, or otherwise longitudinally shaped (e.g., such that the length of the apparatus is at least twice the width of the apparatus), as shown in FIGS. 1-2. Apparatus 20 further comprises at least one set 27 of blades 26, and a soap holder 28, configured to hold a liquid soap 34. Set 27 of blades 26 is configured to form bubbles from soap 34, as further described below. Outer shell 24, soap holder 28, and blades 26 may be made of any suitable material(s), such as, for example, a plastic. Set 27 may comprise any suitable number of blades, such as three, four, five, six, seven, or more blades.

Typically, set 27 is disposed at the end of outer shell 24, with the axis of rotation 31 of set 27 being parallel to the longitudinal axis 48 of outer shell 24. (In the context of the present application, including the claims, a "longitudinal axis" of an object is an axis that runs along the length of the object, e.g., through the radial center of the object.) It is noted, however, that other configurations are included within the scope of the present disclosure.

FIG. 1 depicts apparatus 20 coupled to the inside wall of a bathtub 22 containing water 38. As shown, apparatus 20 is configured such that, when the outer shell is partly submerged in the water with the longitudinal axis 48 of the outer shell being parallel to the surface of the water, the set of blades is partly submerged in the water. Hence, as blades 26 spin (as depicted by a first spin indicator 29) around axis of rotation 31, the blades lift water from the bathtub. As further described below, as the blades pass the water through the air above water 38, the blades receive soap 34 from soap holder 28, such that a mixture of soap and water is formed on the blades. As the blades pass this mixture through the air, soap bubbles are formed.

Typically, apparatus 20 comprises a suction holder 30 coupled to outer shell 24, which couples the outer shell to the wall of the bathtub. Alternatively, apparatus 20 may comprise another type of coupling mechanism for coupling the apparatus to the wall of the bathtub, or apparatus 20 may be allowed to freely float in water 38, e.g., as described below with reference to FIG. 3.

FIG. 2 shows outer shell 24 partially removed, such as to reveal a motor 42, which is disposed within the outer shell and coupled (e.g., directly, or via a shaft) to the set of blades. Motor 42 forms the soap bubbles by spinning the set of blades at any suitable rate, such as a rate of tens, hundreds, or thousands of rotations per second. Typically, apparatus 20 comprises one or more (waterproof) battery chambers 46, configured to receive standard batteries that power the motor.

Motor 42 is activated using an activation mechanism 44, comprising, for example, a push button or self-locking switch. Activation mechanism 44 may be disposed, for example, at the opposite end of outer shell 24 from set 27. In some embodiments, the apparatus comprises a printed circuit board (PCB) (not shown), disposed within the outer shell near the activation mechanism, and connected to the motor via wires. In addition to facilitating the activation (and deactivation) of the motor via activation mechanism 44, the PCB may comprise temperature-control circuitry, configured to deactivate the motor if the motor (atypically) begins to overheat.

Typically (for all embodiments described herein), soap 34, when contained in soap holder 28, is not mixed with water, aside from any water from the bathtub that might splash into the soap holder during operation of the apparatus. In other words, apparatus 20 typically does not require the provision of a bubble bath mixture, or any other mixture of soap and water; rather, normal liquid soap may be used.

Typically, soap holder 28 comprises a receptacle 33, shaped to define a plurality of apertures 40, which holds the liquid soap. Receptacle 33 is configured to couple to outer shell 24 (e.g., via an arm 36) such that the receptacle is positioned above the blades; hence, as the motor spins the set of blades, the soap drips, via the apertures, onto the blades. FIG. 1 thus shows droplets 32 of soap 34 dripping onto blades 26. As described above, upon droplets 32 coming into contact with the moving wet blades, soap bubbles are formed from the droplets. Alternatively or additionally, soap 34 may drip into the bathwater in the vicinity of the spinning blades, thus forming a mixture with the bathwater. The blades may then lift this mixture from the bathtub, and form soap bubbles by passing this mixture through the air.

In some cases, water may splash into receptacle 33, thus mixing with the soap within the receptacle. This mixing may expedite the generation of further soap bubbles.

Typically, the rotating blades do not present a hazard to the occupants of the bathtub. Nevertheless, as an extra precaution, apparatus 20 may comprise a protective mesh 23, which couples to outer shell 24 over the set of blades. Mesh 23 is shaped to define openings 37 large enough for passage therethrough of the soap and water, but small enough to inhibit a finger from passing therethrough, such that the finger does not contact blades 26. Additional soap bubbles may form in the space between the mesh and the blades. In some embodiments, apparatus 20 comprises more than one set 27 of blades. For example, apparatus 20 may comprise two sets of blades, one set at each end of a cylindrical outer shell 24, and motor 42 may spin both sets of blades simultaneously. In such embodiments, apparatus 20 may comprise two soap holders 28, each one being positioned above a respective one of the sets of blades.

In some embodiments, each blade 26 runs along the length of a common central cylindrical shaft that is rotated about axis of rotation 31, such that the length of each blade is parallel to axis of rotation 31. Typically, each blade 26 is shaped to define one or more apertures 25, which pass from one face of the blade to an opposite face of the blade. (In this context, the "faces" of the blade refer to the two surfaces of the blade that are normal, or approximately normal, to the instantaneous velocity vector 35 of the blade as the blade spins. The area of each of these surfaces, including the surface area of any apertures in the surface, is typically greater than that of any non-face surface of the blade.) Apertures 25 may have any suitable shape, such as, for example, a wholly or partly rectangular shape, and/or a wholly or partly circular shape. In some embodiments, as shown in FIGS. 1-2, apertures 25 occupy most (e.g., at least 60%, 70%, 80%, or 90%) of the faces of the blade, i.e., most of the blade faces are open. As described above in the Overview, apertures 25 may facilitate greater access of air to the soapy water on the blades, and/or reduce resistance to the spinning of the blades.

Figure 3:
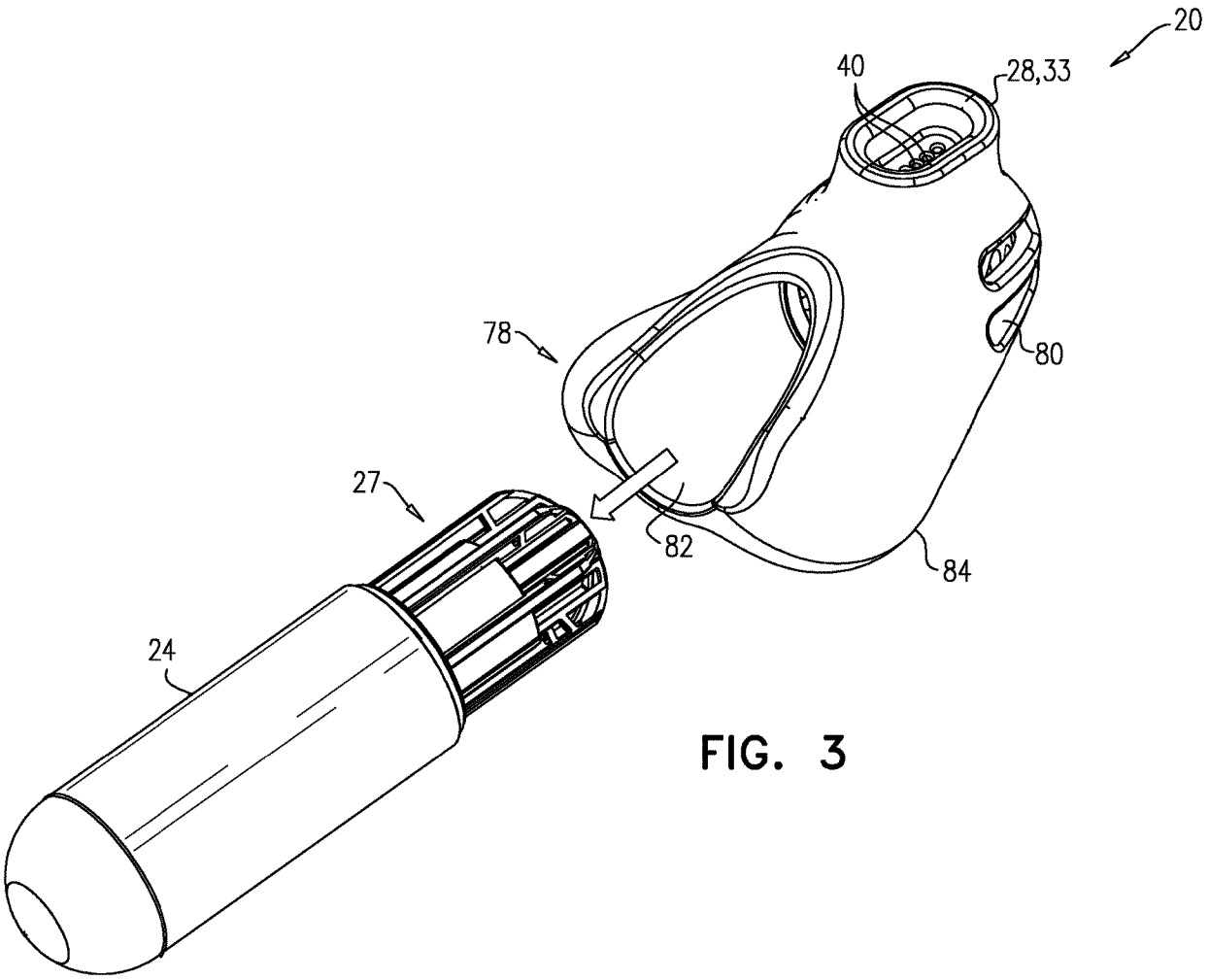

Reference is now made to FIG. 3, which is a schematic illustration of apparatus 20, in accordance with other embodiments of the present invention.

As noted above with reference to FIGS. 1-2, in some embodiments, apparatus 20 does not comprise suction holder 30, but rather, apparatus 20 is allowed to freely float in the bathtub. For example, outer shell 24 may be sufficiently buoyant such that apparatus 20 floats in the bathtub, with the set of blades being partly submerged. Alternatively or additionally, as shown in FIG. 3, apparatus 20 may comprise a buoyant cover 78, comprising, for example, a sponge (such as a rubber or cellulose sponge), which is configured to cover the set of blades, typically in lieu of mesh 23. In addition to contributing to the safety of apparatus 20 by inhibiting fingers from touching the blades, cover 78 contributes to the buoyancy of apparatus 20. (It is noted that cover 78 does not float completely above the water, but rather, floats only partially, such that the set of blades remains partially submerged.) Furthermore, typically, cover 78 is shaped to define soap holder (comprising receptacle 33), such that apparatus 20 need not necessarily comprise arm 36 or a separate soap holder.

Cover 78 is shaped to define a frontal opening 82. Prior to placement of apparatus 20 in the bathtub, cover 78 is passed over the blades (and/or the blades are inserted into the cover), such that the blades enter the cover via frontal opening 82. Typically, the diameter of frontal opening 82 is slightly less than the diameter of outer shell 24, such that cover 78, which is typically made of a resilient material, couples to outer shell 24 by squeezing outer shell 24. Alternatively or additionally, any suitable clips, hooks, or other fasteners may hold the cover to the outer shell.

Typically, cover 78 is shaped to define a plurality of cover-apertures 80, which are typically arranged along the sides and bottom of cover 78. Cover-apertures 80 facilitate passage of the bathwater to the set of blades. (Nevertheless, typically, cover-apertures 80 are narrow enough to inhibit the passage of fingers therethrough.) In some embodiments, cover 78 comprises wings 84, which contribute to the buoyancy of the cover.

Figure 4:
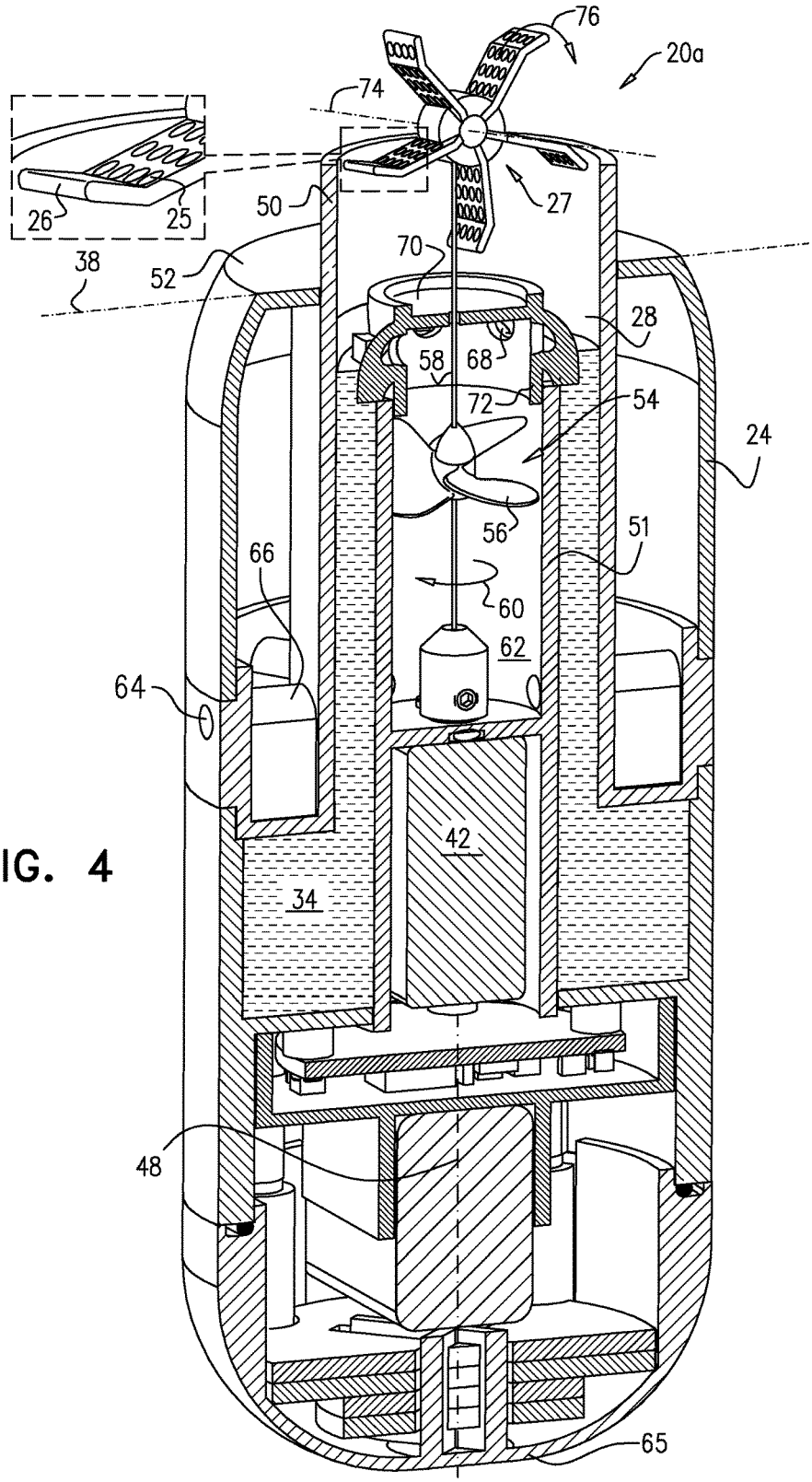
FIG. 4 is a schematic illustration of an alternate apparatus for forming soap bubbles, in accordance with some embodiments of the present invention.

Reference is now made to FIG. 4, which is a schematic illustration of an alternate apparatus **20*a*** for forming soap bubbles, in accordance with some embodiments of the present invention.

Apparatus **20*a* is similar to apparatus 20, in that apparatus 20*a* comprises an outer shell 24 (which, for example, may be cylindrically shaped), a soap holder 28, a set 27 of blades 26 (which are typically shaped to define apertures 25), and a motor 42 disposed within outer shell 24 and coupled to set 27. (In FIG. 4, part of outer shell 24 is removed, in order to show various elements of apparatus 20*a* that would otherwise be hidden from view.) As in the case of apparatus 20, motor 42 forms soap bubbles by spinning the set of blades such that the blades pass, through air, a mixture of liquid soap from the soap holder and water from the bathtub. Furthermore, similarly to apparatus 20, apparatus 20***a* may comprise a suction holder 30 (not shown in FIG. 4) coupled to outer shell 24, the suction holder being configured to couple the outer shell to the wall of the bathtub. Alternatively, as for apparatus 20, apparatus 20*a* may be coupled to the wall of the bathtub in any other suitable way, or apparatus 20*a* may be allowed to freely float in the water.

Notwithstanding the above, apparatus 20*a* differs from apparatus 20, as shown in FIGS. 1-3, in several respects. For example, in apparatus 20*a*, soap holder 28 is at least partly (e.g., mostly) contained within the outer shell. Typically, soap holder 28 comprises an outer wall 50 and an inner wall 51, inner wall 51 being disposed radially inward from outer wall 50. (Typically, in embodiments in which outer shell 24 is cylindrically shaped, the outer wall and inner wall are also cylindrically shaped.) Soap 34 is held, by the soap holder, at least between the outer wall and inner wall. Typically, outer wall 50 is longer than inner wall 51; for example, whereas inner wall 51 may be entirely contained within the outer shell, outer wall 50 may protrude a short distance (e.g., one or more centimeters) from the top face 52 of the outer shell. Typically, the set of blades is at least partly contained within the soap holder, e.g., within outer wall 50, above top face 52.

Inner wall 51 surrounds a central chamber 62, which is typically located at the radial center of the outer shell. Apparatus 20*a* comprises an impeller 54, comprising, for example, a plurality of blades 56 coupled to a central shaft 58, which is disposed within central chamber 62. For example, one product that embodies impeller 54, as generally shown in FIG. 3, is the NQD-757 757-6024 Propeller for RC Boat Turbo JET. As another example, apparatus 20*a* may comprise a water pump, such as an AS2601400 DC Water Pump Motor Brush, that comprises impeller 54. Motor 42 is coupled to impeller 54, and is configured to spin the impeller, e.g., by spinning shaft 58, as indicated in FIG. 4 by a second spin indicator 60. Apparatus 20*a* typically comprises one or more waterproof battery chambers, configured to hold one or more batteries that power motor 42.

Outer shell 24 is shaped to define one or more apertures 64, each of which is in fluid communication with central chamber 62 via a respective passageway 66. Typically, passageways 66 are not in direct fluid communication with soap holder 28; rather, passageways 66 are only in indirect fluid communication with soap holder 28, via central chamber 62.

Prior to use of apparatus 20*a*, soap holder 28 is filled at least partly with liquid soap 34. (The soap may rise above the top of inner wall 51.) Apparatus 20*a* is then placed in water 38, such that apertures 64 are submerged. The orientation of apparatus 20*a*, when disposed in the water, is typically upright, with longitudinal axis 48 being perpendicular to the water level. (In contrast, apparatus 20, as shown in FIG. 1, is typically disposed on its side, with longitudinal axis 48 being parallel to the water level.) Typically, apparatus 20*a* is placed in the water such that most of outer shell 24 is submerged; for example, top face 52 may be approximately level with the water. (Typically, top face 52 closes tightly around outer wall 50, such that water does not enter the outer shell through the top face.)

Subsequently, the impeller, as it is turned by the motor, draws water, via the apertures, into the soap holder. For example, the impeller may draw water into central chamber, such that the water rises, within the central chamber, toward a roof 70 of the central chamber. Below roof 70, inner wall 51, or a separate structure 72 that comprises roof 70 and hence closes the top of the inner wall, may be shaped to define a plurality of inner apertures 68. The water passes through inner apertures 68 and into soap holder 28, thus mixing with the soap in soap holder 28. This mixture of soap and water then rises toward set 27 of blades. As blades 26 spin, as indicated by a third spin indicator 76, the blades lift the soapy water (i.e., the mixture of soap and water) from the soap holder, and then pass the soapy water through the air, thus forming soap bubbles.

Typically, the axis of rotation 74 of the set of blades is perpendicular to longitudinal axis 48. Nonetheless, a single motor 42 may rotate both impeller 54 and set 27. For example, a gear located behind the set of blades (not visible in the figure), coupled to shaft 58 and to the set of blades, may convert the rotational motion of the shaft (as indicated by second spin indicator 60) around an axis of rotation that is parallel to longitudinal axis 48 into rotational motion around axis of rotation 74. Alternatively, apparatus 20*a* may comprise two motors; one that spins the impeller, and another that spins the set of blades.

In some embodiments, apparatus 20*a* is reversibly coupled to the floor of the bathtub, e.g., via a suction holder coupled to the bottom 65 of outer shell 24. As yet another alternative, the bathtub may be manufactured to include apparatus 20*a* as an integral component thereof, with apparatus 20*a* being fixedly attached to the floor of the bathtub, and, for example, with motor 42 being connected to the electrical infrastructure of the home in which the bathtub is located, or powered by batteries located inside the wall of the bathtub. In such embodiments, apparatus 20*a* is tall enough such that the set of blades is exposed to air even with a relatively high level of water in the bathtub, yet apertures 64 are low enough such that the apertures are submerged even with a relatively low water level. For example, apertures 64 may be located less than 10 cm from bottom 65.

Figure 5:
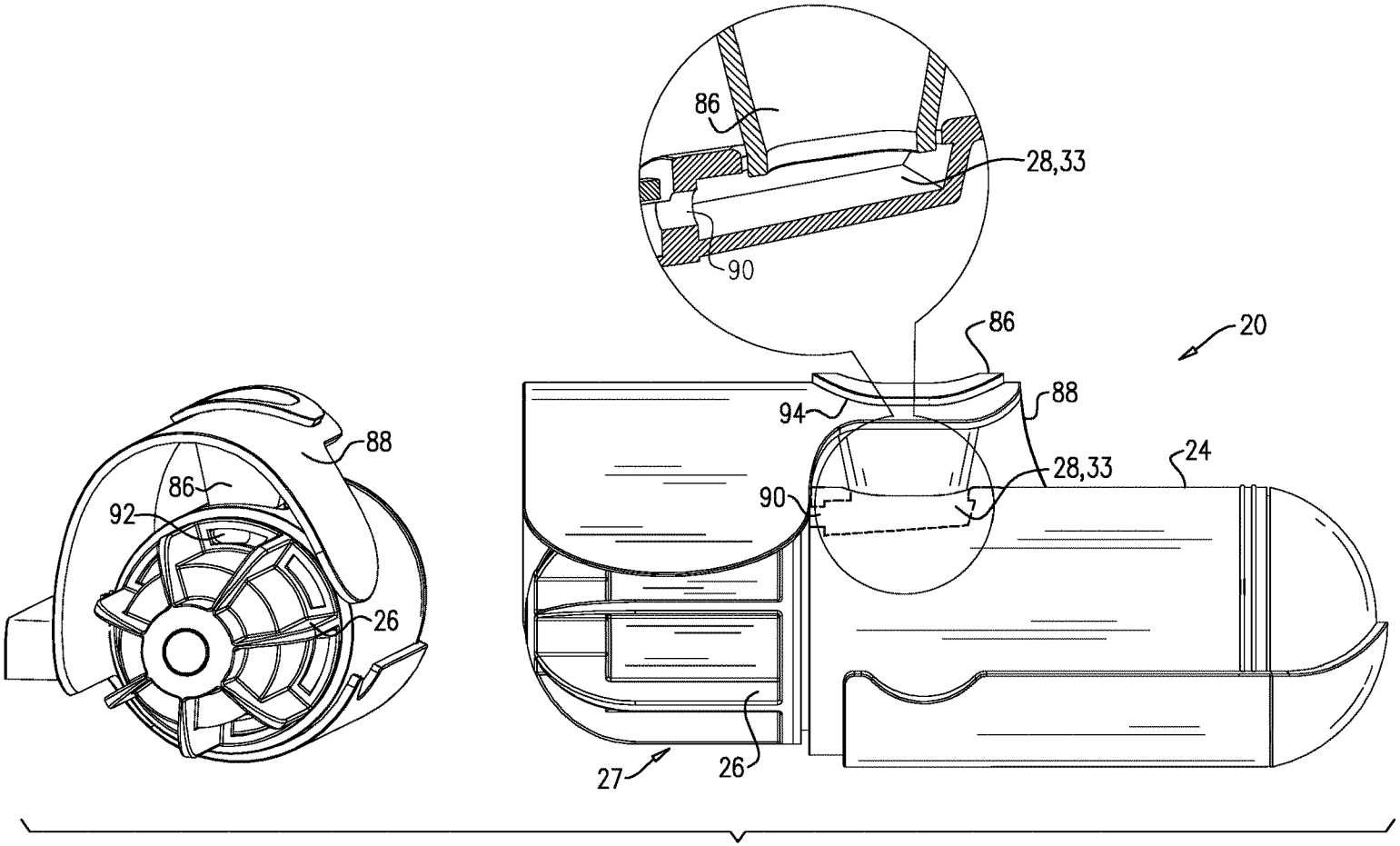
FIG. 5 is a schematic illustration of the apparatus of FIGS. 1-3, in accordance with some other embodiments of the present invention.

Reference is now made to FIG. 5, which is a schematic illustration of apparatus 20, in accordance with some other embodiments of the present invention.

In some embodiments, as shown in FIG. 5, soap holder 28 comprises a receptacle 33 that is at least partly (e.g., fully) contained within outer shell 24, and outer shell 24 is shaped to define an aperture 92 positioned behind the set of blades and in fluid communication with the soap holder. For example, a tunnel 90 may pass from the soap holder to aperture 92, or the soap holder itself may open at aperture 92. As the motor spins the set of blades, the soap drips from the soap holder, via aperture 92, onto the set of blades, and/or into the bathwater below. For example, the soap holder, and/or tunnel 90, may slope downwards towards the set of blades, such that, when the outer shell is coupled to the bathtub in a horizontal orientation, or is allowed to float in a horizontal orientation, the soap drips, or flows, from the soap holder via aperture 92. Alternatively or additionally, the outer shell may be coupled to the bathtub at a angle, with the set of blades pointing slightly downwards, such that the soap drips, or flows, from the soap holder via aperture 92.

In some embodiments, apparatus 20 further comprises a funnel 86 configured for insertion into the soap holder. Funnel 86 facilitates the pouring of liquid soap into soap holder 28. (The inset portion of FIG. 5 shows a cross-section through the soap holder and bottom portion of the funnel.) In some embodiments, apparatus 20 further comprises a frame 88 coupled to outer shell 24, which may be shaped to define an opening 94 through which funnel 86 passes. Apparatus 20 may be coupled to the bathtub wall via frame 88, e.g., via a suction holder.

Figure 6:
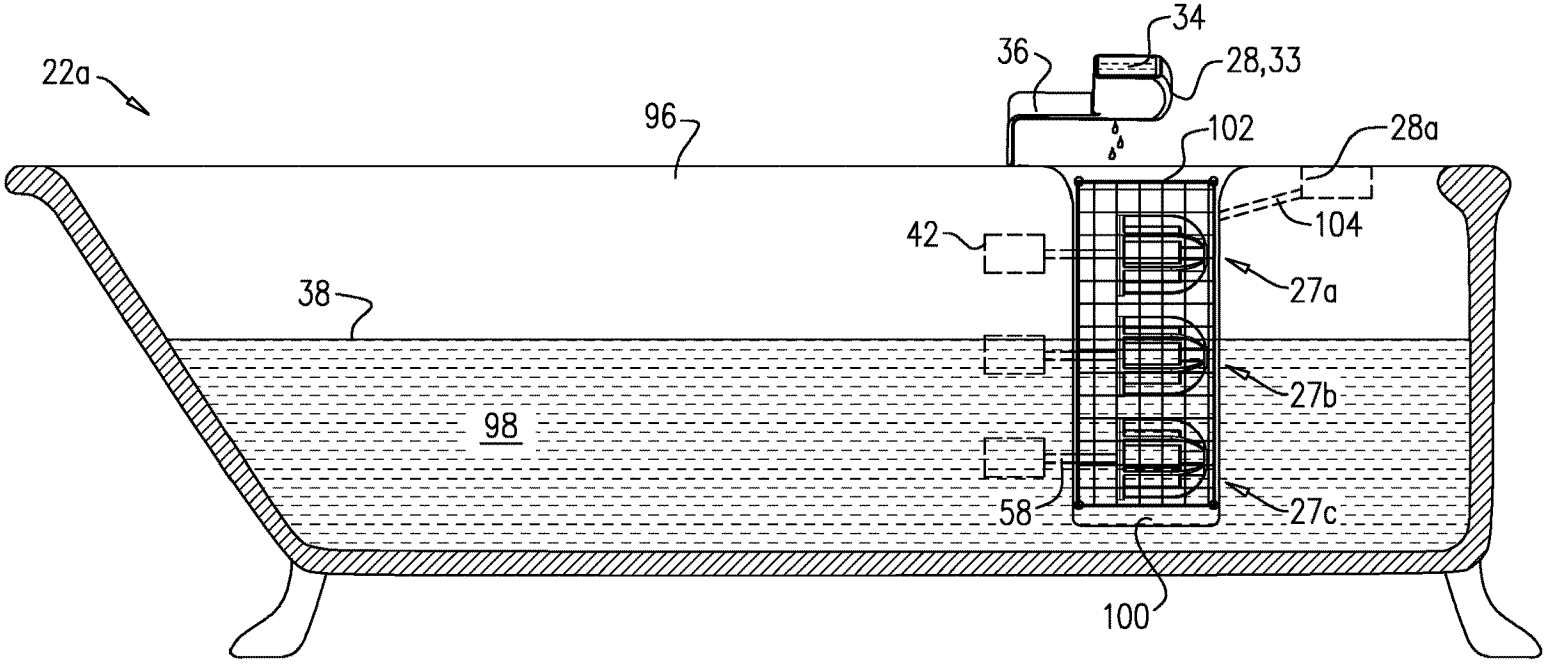
FIG. 6 is a schematic illustration of a soap-spinning bathtub, in accordance with some embodiments of the present invention.

Reference is now made to FIG. 6, which is a schematic illustration of a soap-spinning bathtub 22*a*, in accordance with some embodiments of the present invention.

Bathtub 22*a* comprises a plurality of walls surrounding a bathing chamber 98, which may be filled with water 38, and in which individuals may bathe. At least one wall 96 of the walls is shaped to define a side chamber 100 in fluid communication with bathing chamber 98, such that, upon the bathing chamber being sufficiently filled with water 38, some of the water enters side chamber 100. A protective mesh 102 may divide between the side chamber and the bathing chamber.

Bathtub 22*a* further comprises one or more sets of blades disposed within the side chamber; for example, a plurality of sets of blades may be arranged vertically within the side chamber. As a specific example, bathtub 22*a* may comprise three sets of blades: a first set 27*a*, a second set 27*b* beneath first set 27*a*, and a third set 27*c* beneath second set 27*b*. Each of the sets may be similar to any of the sets of blades shown in, or described above with reference to, any of the previous figures, or may, alternatively, have any other suitable form.

At least one motor 42 is coupled to the sets of blades. For example, a single motor 42 may be coupled to all of the sets via respective gear joints, such that the single motor is configured to spin all of the sets. Alternatively, a separate motor may be coupled to each of the sets, e.g., via a respective shaft 58, such that each of the sets is spun by a different respective motor. Motors 42 may be connected to the electrical infrastructure of the home in which bathtub 22*a* is located; alternatively, the motors may be powered by batteries located, for example, inside wall 96.

Bathtub 22*a* further comprises soap holder 28, which is configured to hold liquid soap 34. In some embodiments, soap holder 28 comprises receptacle 33, the bottom of which, as in FIG. 2, is shaped to define one or more apertures 40. Soap 34 drips, via apertures 40, onto the blades and/or into the water in the side chamber, thus forming a soap-water mixture in the side chamber. Receptacle 33 may be coupled to the bathtub in any suitable manner. For example, the receptacle may be coupled to the top surface of wall 96 via arm 36, or it may, alternatively, be placed directly over or into side chamber 100. As yet another alternative, wall 96 may be shaped to define an internal soap holder 28*a*, along with a passage 104 that passes from the soap holder to side chamber 100. The soap may then drip or flow, via passage 104, onto the blades and/or into the water in the side chamber, thus forming a soap-water mixture in the side chamber.

In some embodiments, upon the user activating the motors (e.g., by pushing an activation button, or flipping an activation switch), the motors spin all of the sets of blades. Typically, the sets of blades are arranged such that, for any water level within a particular range of water levels, at least one of the sets of blades is partly submerged. (For example, for the water level shown in FIG. 6, second set 27*b* is partly submerged.) This set of blades, when spun, generates soap bubbles, by lifting water 38 from the side chamber, and passing the lifted water through the air while receiving the soap from the soap holder (i.e., while the soap drips onto the blades). Alternatively or additionally, this set of blades may generate soap bubbles by lifting a water-soap mixture from the side chamber, and passing this mixture through the air.

In other embodiments, only the set of blades that is partly submerged is spun. For example, each set of blades may be coupled to one or more sensors, which sense whether the set of blades is in contact with water 38. A processor may then receive appropriate signals from these sensors, and, in response to these signals, cause the motors to spin only the topmost set of blades that is in contact with the water.

It will be appreciated by persons skilled in the art that the present invention is not limited to what has been particularly shown and described hereinabove. Rather, the scope of embodiments of the present invention includes both combinations and subcombinations of the various features described hereinabove, as well as variations and modifications thereof that are not in the prior art, which would occur to persons skilled in the art upon reading the foregoing description. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. Apparatus for use with liquid soap, the apparatus comprising:

an outer shell;

at least one set of blades at least partly exposed outside the outer shell, the set of blades being configured to lie partly submerged in water in a bathtub; and a motor disposed within the outer shell and coupled to the set of blades, the motor being configured to form soap bubbles while the set of blades is at least partly exposed and is partly submerged in the water by spinning the set of blades such that the blades:

lift the water from the bathtub, and pass the lifted water, together with the liquid soap, through air.

2. The apparatus according to claim 1, further comprising a suction holder coupled to the outer shell, the suction holder being configured to couple the outer shell to a wall of the bathtub.

3. The apparatus according to claim 1, further comprising a mesh configured to couple to the outer shell over the set of blades.

4. The apparatus according to claim 1, wherein each of the blades is shaped to define one or more apertures passing from one face of the blade to an opposite face of the blade.

5. The apparatus according to claim 1, wherein the set of blades is coupled to the outer shell such that, when the outer shell is partly submerged in the water with a longitudinal axis of the outer shell being parallel to a surface of the water, the set of blades is partly submerged in the water.

6. The apparatus according to claim 5, wherein an axis of rotation of the set of blades is parallel to the longitudinal axis of the outer shell.

7. The apparatus according to claim 1, further comprising a soap holder configured to hold the liquid soap, wherein the soap holder comprises a receptacle shaped to define one or more apertures and configured to couple to the outer shell such that, as the motor spins the set of blades, the soap drips from the receptacle via the apertures.

8. The apparatus according to claim 7, wherein the soap holder is configured to couple to the outer shell such that the soap drips, via the apertures, onto the blades.

9. The apparatus according to claim 7, wherein the soap holder is configured to couple to the outer shell such that the soap drips, via the apertures, into the bathtub.

10. The apparatus according to claim 1, wherein the outer shell is buoyant.

11. The apparatus according to claim 1, further comprising a soap holder configured to hold the liquid soap, wherein the outer shell is shaped to define an aperture positioned behind the set of blades and in fluid communication with the soap holder, such that, as the motor spins the set of blades, the soap drips, via the aperture, onto the set of blades.

12. The apparatus according to claim 11, wherein the soap holder is at least partly contained within the outer shell.

13. Apparatus for use in a bathtub containing water, the apparatus comprising:

an outer shell, shaped to define one or more apertures;

an impeller disposed within the outer shell;

a soap holder, contained within the outer shell and configured to hold a liquid soap;

at least one set of blades; and at least one motor disposed within the outer shell and coupled to the set of blades and to the impeller, the motor being configured to form soap bubbles while the apertures are submerged in the water, by:

turning the impeller such that the impeller draws the water, via the apertures, into the soap holder, thus forming a mixture of the water and the liquid soap, and spinning the set of blades such that the blades lift the mixture from the soap holder, and pass the mixture through air.

14. The apparatus according to claim 13, wherein the set of blades is at least partly contained within the soap holder.

15. The apparatus according to claim 13, wherein an axis of rotation of the set of blades is perpendicular to a longitudinal axis of the outer shell.

16. Apparatus for use with liquid soap, the apparatus comprising:

a bathtub comprising a plurality of walls surrounding a bathing chamber configured to contain water, at least one of the walls being shaped to define a side chamber in fluid communication with the bathing chamber;

one or more sets of blades disposed within the side chamber, the sets of blades being arranged such that, for any level of the water within a range of levels, at least one of the sets of blades is partly submerged in the water; and at least one motor coupled to the sets of blades, the motor being configured to form soap bubbles by spinning the partly submerged one of the sets of blades such that the blades of the partly submerged one of the sets:

lift the water from the side chamber, and pass the lifted water, together with the liquid soap, through air.

17. The apparatus according to claim 16, further comprising a mesh that divides between the side chamber and the bathing chamber.

18. The apparatus according to claim 16, wherein the one or more sets of blades comprise a vertically-arranged plurality of sets of blades.

19. The apparatus according to claim 16, further comprising a soap holder configured to hold the liquid soap, wherein the soap holder comprises a receptacle shaped to define one or more apertures and configured to couple to the bathtub such that, as the motor spins the at least one of the sets of blades, the soap drips from the receptacle, via the apertures, into the side chamber.

20. The apparatus according to claim 16, wherein the one of the walls is further shaped to define a soap holder, which is configured to hold the liquid soap, and a passage passing from the soap holder to the side chamber, such that, as the motor spins the at least one of the sets of blades, the soap drips from the soap holder, via the passage, into the side chamber.

21. A method, comprising:

using a motorized set of blades that is at least partly exposed and is partly submerged in water in a bathtub, lifting the water from the bathtub; and using the set of blades, forming soap bubbles by passing the lifted water, together with liquid soap, through air.

22. The method according to claim 21, wherein forming the soap bubbles comprises forming the soap bubbles by passing the lifted water through the air while receiving the liquid soap from a soap holder.

23. The method according to claim 21, wherein the liquid soap drips into the bathtub, thus forming a mixture with the water, wherein lifting the water comprises lifting the water by lifting the mixture from the bathtub, and wherein forming the soap bubbles comprises forming the soap bubbles by passing the mixture through the air.

24. The method according to claim 21, wherein a wall of the bathtub is shaped to define a side chamber in fluid communication with a bathing chamber of the bathtub, and wherein lifting the water comprises lifting the water from the side chamber.

25. The method according to claim 21, wherein the set of blades is covered by a mesh, and wherein forming the soap bubbles comprises forming some of the soap bubbles in a space between the set of blades and the mesh.

26. The method according to claim 22, wherein the liquid soap, when contained in the soap holder, is not mixed with water.

27. A method, comprising:

using a motor that is disposed within an outer shell and is coupled to (i) an impeller disposed within the outer shell, and (ii) a set of blades, turning the impeller such that the impeller draws water from a bathtub, via apertures in the outer shell, into a soap holder that is contained within the outer shell and holds a liquid soap, thus forming a mixture of the water and the liquid soap; and using the motor, forming soap bubbles by spinning the set of blades such that the blades lift the mixture from the soap holder and pass the mixture through air.

28. The apparatus according to claim 1, wherein the set of blades is fully exposed.

29. The apparatus according to claim 3, wherein the mesh is shaped to define a plurality of openings such that, when the mesh is coupled to the outer shell over the set of blades, the set of blades is partly exposed via the openings.

30. The apparatus according to claim 16, wherein the side chamber is a recess in the at least one of the walls.

31. Apparatus for use with liquid soap, the apparatus comprising:

an outer shell;

at least one set of blades disposed outside the outer shell, the set of blades being configured to lie partly submerged in water in a bathtub;

a buoyant sponge configured to cover the set of blades; and a motor disposed within the outer shell and coupled to the set of blades, the motor being configured to form soap bubbles while the set of blades is partly submerged in the water by spinning the set of blades such that the blades:

lift the water from the bathtub, and pass the lifted water, together with the liquid soap, through air.

32. The apparatus according to claim 31, wherein the sponge is shaped to define a soap holder configured to hold the liquid soap.

33. The apparatus according to claim 31, wherein the sponge is shaped to define a plurality of apertures configured to facilitate passage of the water through the sponge.

* * * * *